US006473037B2

(12) United States Patent
Vail et al.

(10) Patent No.: US 6,473,037 B2
(45) Date of Patent: Oct. 29, 2002

(54) PHASED ARRAY ANTENNA SYSTEM HAVING PRIORITIZED BEAM COMMAND AND DATA TRANSFER AND RELATED METHODS

(75) Inventors: David Kenyon Vail, West Melbourne; Frank J. Tabor, Melbourne; Daniel P. Blom, Palm Bay; Stephen S. Wilson, Melbourne, all of FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 09/991,536

(22) Filed: Nov. 9, 2001

(65) Prior Publication Data

US 2002/0084934 A1 Jul. 4, 2002

Related U.S. Application Data

(60) Provisional application No. 60/255,007, filed on Dec. 12, 2000.

(51) Int. Cl.[7] ..... H01Q 3/22; H01Q 3/24; H01Q 3/26

(52) U.S. Cl. ..... 342/372; 342/368; 342/157

(58) Field of Search ..... 342/372, 157, 342/368

(56) References Cited

U.S. PATENT DOCUMENTS

| | | | | |
|---|---|---|---|---|
| 4,931,803 | A | 6/1990 | Shimko | 342/371 |
| 4,980,691 | A | 12/1990 | Rigg et al. | 342/372 |
| 4,994,814 | A | 2/1991 | Aoki et al. | 342/372 |
| 4,996,532 | A | 2/1991 | Kirimoto et al. | 342/81 |
| 5,008,680 | A | 4/1991 | Willey et al. | 342/372 |
| 5,027,126 | A | 6/1991 | Basehgi et al. | 342/372 |
| 5,072,228 | A | 12/1991 | Kuwahara | 342/360 |
| 5,225,841 | A | 7/1993 | Krikorian et al. | 342/204 |
| 5,231,405 | A | 7/1993 | Riza | 342/375 |
| 5,243,274 | A | 9/1993 | Kelsey et al. | 324/158 R |
| 5,283,587 | A | 2/1994 | Hirshfield et al. | 342/372 |
| 5,353,031 | A | 10/1994 | Rathi | 342/372 |
| 5,493,255 | A | 2/1996 | Murtojarvi | 330/296 |
| 5,559,519 | A | 9/1996 | Fenner | 342/174 |
| 5,592,179 | A | 1/1997 | Windyka | 342/372 |
| 5,655,841 | A | 8/1997 | Storm | 374/183 |
| 5,680,141 | A | 10/1997 | Didomenico et al. | 342/372 |
| 5,771,016 | A | 6/1998 | Mullins et al. | 342/372 |
| 5,938,779 | A | 8/1999 | Preston | 714/718 |
| 5,990,830 | A | 11/1999 | Vail et al. | 342/368 |
| 5,995,740 | A | 11/1999 | Johnson | 395/500.41 |
| 5,999,990 | A | 12/1999 | Sharrit et al. | 718/8 |
| 6,011,512 | A | 1/2000 | Cohen | 342/372 |
| 6,023,742 | A | 2/2000 | Ebeling et al. | 710/107 |
| 6,157,681 | A | 12/2000 | Daniel et al. | 375/298 |
| 6,163,220 | A | 12/2000 | Schellenberg | 330/295 |
| 6,172,642 | B1 | 1/2001 | DiDomenico et al. | 342/368 |

*Primary Examiner*—Theodore M. Blum
(74) *Attorney, Agent, or Firm*—Allen, Dyer, Doppelt, Milbrath & Gilchrist, P.A.

(57) ABSTRACT

A phased array antenna system may include a substrate and a plurality of phased array antenna elements carried thereby, and a plurality of subarray controllers for controlling respective groups of phased array antenna elements. The phased array antenna system may further include a central controller for generating priority beam control commands and non-priority beam control commands for the subarray controllers, and a communications bus connecting the subarray controllers to the central controller. The central controller may send the priority beam control commands to the subarray controllers via the communications bus on a substantially real time basis with time gaps therebetween. Further, the central controller may also send the non-priority beam control commands to the subarray controllers via the communications bus during the time gaps.

32 Claims, 4 Drawing Sheets

PHASED ARRAY ANTENNA SYSTEM HAVING PRIORITIZED BEAM COMMAND AND DATA TRANSFER AND RELATED METHODS

RELATED APPLICATION

This application is based upon prior filed copending provisional application Ser. No. 60/255,007 filed Dec. 12, 2000, the entire subject matter of which is incorporated herein by reference in its entirety.

FIELD OF THE INVENTION

The present invention relates to the field of communications, and, more particularly, to phased array antenna systems and related methods.

BACKGROUND OF THE INVENTION

Antenna systems are widely used in both ground based applications (e.g., cellular antennas) and airborne applications (e.g., airplane or satellite antennas). For example, so-called "smart" antenna systems, such as adaptive or phased array antenna systems, combine the outputs of multiple antenna elements with signal processing capabilities to transmit and/or receive communications signals (e.g., microwave signals, RF signals, etc.). As a result, such antenna systems can vary the transmission or reception pattern (i.e., "beam shaping" or "spoiling") or direction (i.e., "beam steering") of the communications signals in response to the signal environment to improve performance characteristics.

A typical phased array antenna system may include, for example, a host processor for generating host commands and a central controller for processing the host commands and generating beam control commands (e.g., beam steering control commands and/or beam spoiling central commands) for the antenna elements based thereon. One or more element controllers may be used for controlling the antenna elements based upon the beam control commands. In larger phased array antenna systems, subarray controllers may also be connected between groups of element controllers and the central controller to aid in beam control command processing and signal distribution, for example.

One problem that may become particularly acute in large phased array antenna systems is that of efficiently distributing the beam control commands from the central controller to the subarray controllers. More particularly, a communications bus (e.g., a serial bus) is typically used to connect the central controller and subarray controllers. Yet, numerous beam control commands other than just beam steering/spoiling commands may also need to be sent via the communications bus, such as operating frequency commands, temperature compensation commands, and telemetry request commands, for example. Furthermore, telemetry data may also need to be collected from the various antenna elements and sent to the central controller via the communications bus.

Several prior art approaches exist for distributing host commands to phased array antenna elements. Perhaps the most straightforward approach is to have the central controller perform essentially all of the beam command processing and send respective beam control commands for each of the antenna elements. Yet, this approach is highly susceptible to the above noted bandwidth problems, especially when fast beamsteer or beam spoiling updates are required. To attempt to compensate for the bandwidth shortfall by using a faster communications bus could increase costs and also result in decreased reliability.

Yet another prior art approach is to use fairly sophisticated subarray processors and essentially pass the host commands along through the central controller to the subarray processors. While this may alleviate bandwidth problems somewhat, the subarray controllers required to implement this approach would need to be fairly complex to perform the requisite processing (e.g., trigonometric calculations) on the host commands. This may lead to increased power consumption and costs if many such subarray controllers are used.

One particularly advantageous prior art approach is disclosed in U.S. Pat. No. 5,990,830 to Vail et al. entitled "Serial Pipelined Phased Weight Generator for Phased Array Antenna Having Subarray Controller Delay Equalization," which is assigned to the present assignee and hereby incorporated herein in its entirety by reference. A central controller receives digitally formatted antenna beam steering data, for example, from a host processor and executes the requisite trigonometric calculations to transform the beam steering data into phase gradient data. Subarray controllers convert the phase gradient data from the central controller into sets of phase control data each for controlling a respective phase shifter, for example. In turn, the phase shifters drive respective phased array antenna elements.

This approach represents a significant advancement in the art in that the central controller does not have to generate all of the respective phase control data sets, which would likely require a very fast (and potentially unreliable) communications bus. Yet, the subarray controllers do not have to perform the more complex trigonometric processing, and thus their complexity need not be as great as in the second prior art approach discussed above. Nonetheless, with an ever increasing number of antenna elements and beam control commands being implemented in phased array antenna systems, even greater bandwidth utilization efficiency may be desirable in many applications.

SUMMARY OF THE INVENTION

In view of the foregoing background, it is therefore an object of the present invention to provide a phased array antenna system with prioritized beam control command and data transfer and related methods.

This and other objects, features, and advantages in accordance with the present invention are provided by a phased array antenna system including a substrate and a plurality of phased array antenna elements carried thereby, and a plurality of subarray controllers for controlling respective groups of phased array antenna elements (or groups of individual element controllers). The phased array antenna system may further include a central controller for generating priority beam control commands and non-priority beam control commands for the subarray controllers, and a communications bus connecting the subarray controllers to the central controller.

Additionally, the central controller may send the priority beam control commands to the subarray controllers via the communications bus on a substantially real time basis with time gaps therebetween. The central controller may also send the non-priority beam control commands to the subarray controllers via the communications bus during the time gaps. As a result of this beam control command prioritization, a more efficient use of the communications bus is achieved with respect to prior art approaches.

More particularly, the central controller may include a priority first-in, first-out (FIFO) device for storing and outputting the priority beam control commands and a non-priority FIFO device for storing and outputting the non-priority beam control commands. The central controller may further include an arbiter for selectively connecting the outputs of the priority FIFO device and the non-priority FIFO device to the communications bus.

In addition, the subarray controllers may collect telemetry data for respective groups of phased array antenna elements and send the telemetry data to the central controller via the communications bus. The central controller may further include a telemetry FIFO device connected to the arbiter, and the arbiter may selectively connect the telemetry FIFO device to the communications bus during the time gaps for storing the telemetry data.

The priority beam control commands may include at least one of beam steering angles or phase gradient commands, beam spoiling commands, and operating frequency commands, and the non-priority beam control commands may include at least one of temperature compensation commands and telemetry request commands, for example. Additionally, the priority beam control commands may be the same for all of the subarray controllers, and the non-priority beam control commands may also be the same for all of the subarray controllers. Further, each subarray controller may convert the priority and non-priority beam control commands into commands for respective phased array antenna elements connected thereto.

The phased array antenna system may also include a host processor for generating host commands, and the central controller may generate the priority beam control commands based upon the host commands. The phased array antenna system may further include a respective element controller for controlling each of the phased array antenna elements.

A method aspect of the invention is for providing beam control commands to a plurality of subarray controllers in a phased array antenna system. The method may include generating priority beam control commands and non-priority beam control commands for the subarray controllers. Further, the method may also include sending the priority beam control commands to the subarray controllers on a higher time priority basis than the non-priority beam control commands.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1:
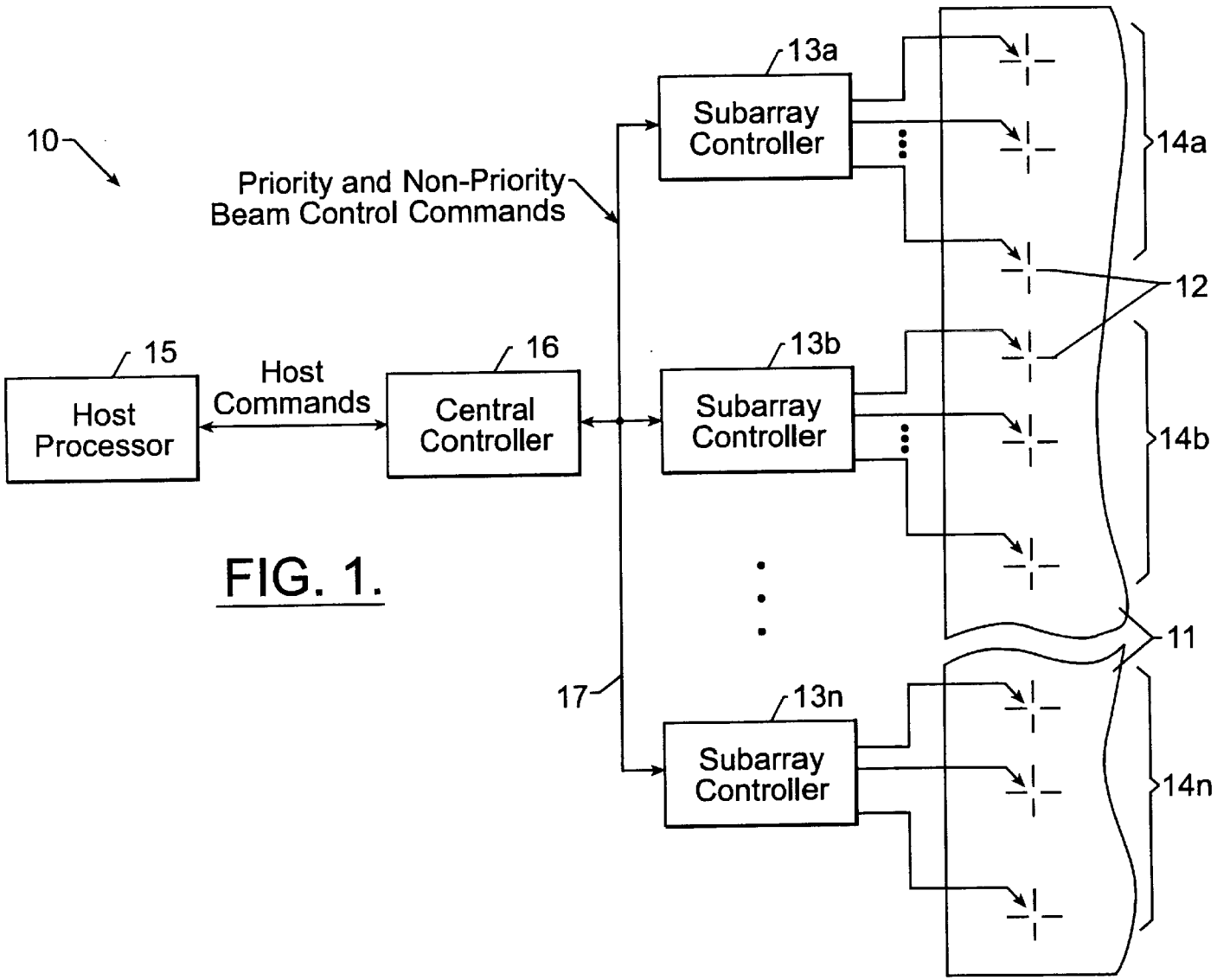
FIG. 1 is schematic block diagram of a phased array antenna system according to the present invention.
Figure 2:
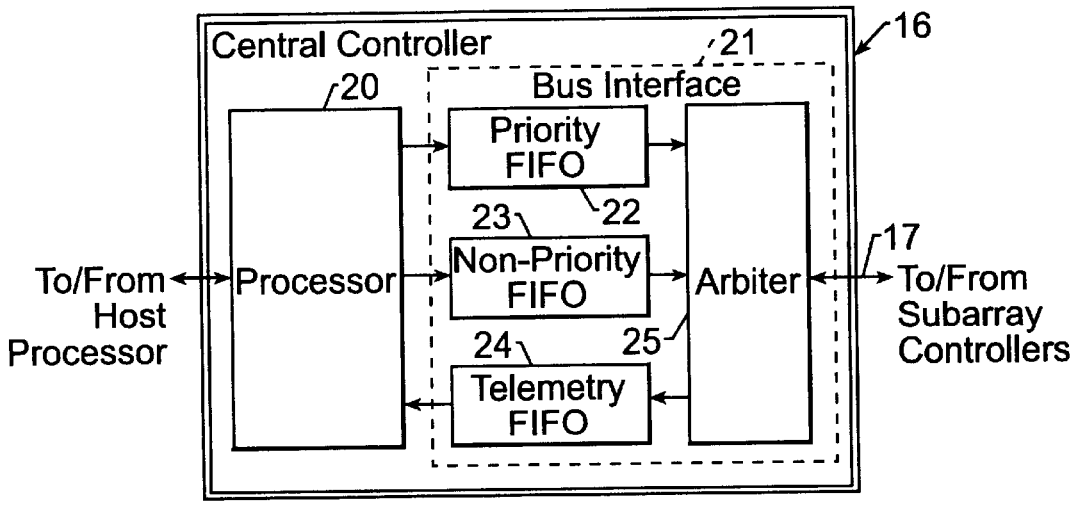
FIG. 2 is a more detailed schematic block diagram of the central controller of FIG. 1.

Referring initially to FIGS. 1 and 2, a phased array antenna system 10 according to the present invention illustratively includes a substrate 11 and a plurality of phased array antenna elements 12 carried thereby. As used herein, "substrate" refers to any surface, mechanized structure, etc., which is suitable for carrying a phased array antenna element, as will be appreciated by those of skill in the art. Furthermore, the phased array antenna system 10 also illustratively includes a plurality of subarray controllers 13*a*–13*n* for controlling respective groups 14*a*–14*n* of phased array antenna elements 12, a host processor 15 for generating host commands, and a central controller 16 connected to the host processor or other host interface.

Additionally, the phased array antenna system 10 also illustratively includes a communications bus 17 connecting the subarray controllers 13*a*–13*n* to the central controller 16. The communications bus 17 may be a serial communications bus, for example, although other types of busses, such as parallel communications buses, may also be used. Of course, those of skill in the art will appreciate that the use of parallel busses may complicate wiring and add connector and wire weight, particularly in antennas with large arrays of antenna elements.

As may be seen in FIG. 2, the central controller 16 illustratively includes a processor 20. The processor 20 generates priority beam control commands for the subarray controllers 13*a*–13*n* based upon the host commands. For example, the priority beam control commands may include beam steering angles or phase gradient commands, beam spoiling commands, and/or operating frequency commands. As will be appreciated by those of skill in the art, it is desirable to implement such commands as soon as possible after they are provided by the host processor. Stated alternatively, it is desirable to implement such commands in as close to real time as is possible.

By way of example, when implementing fast frequency hopping, the host processor 15 may dictate that the operating frequency of the phased array antenna system 10 be changed many thousands of times per second. Similarly rapid changes may also be implemented with respect to beam shape or spoiling or beam steering, for example. According to the present invention, the above listed beam control commands are advantageously given priority for distribution to the subarray controllers 13*a*–13*n* via the communications bus 17. Of course, other priority beam control commands may also be designated in accordance with the invention.

On the other hand, the processor 20 may also generate non-priority beam control commands also to be sent to the subarray controllers 13*a*–13*n* via the communications bus 17. The non-priority beam control commands may include, for example, initialization commands, temperature compensation commands and/or telemetry request commands. More particularly, parameters such as temperature typically do not change as quickly as operating frequency, beam shape, etc., and thus may not require real time updating. Similarly, in those embodiments where telemetry data is to be collected for processing by the processor 20, the central controller 16 may only require telemetry updates on a periodic or infrequent basis. Accordingly, such non-priority beam control commands may be assigned a lower priority status than the priority beam control commands for distribution to the subarray controllers 13*a*–13*n* via the communications bus 17.

The central controller 16 also illustratively includes a bus interface 21 for outputting the priority beam control commands and the non-priority beam control commands to the communications bus 17. More particularly, the bus interface 21 may include a priority first-in, first-out (FIFO) device 22 for storing and outputting the priority beam control commands, and a non-priority FIFO device 23 for storing and outputting the non-priority beam control commands. Additionally, if telemetry data is to be collected from respective groups 14*a*–14*n* of the phased array antenna elements 12 via respective subarray controllers 13*a*–13*n*, the bus interface 21 may also include a telemetry FIFO device 24 for storing the telemetry data received from the subarray controllers.

The bus interface 21 also illustratively includes an arbiter 25 for selectively connecting the output of the priority FIFO device 22, the output of the non-priority FIFO device 23, and the input of the telemetry FIFO device 24 to the communications bus 17. The output of the priority FIFO device 22 (i.e., the priority beam control commands) is given higher priority than the output of the non-priority FIFO device 23 (i.e., the non-priority beam control commands) and the input of the telemetry FIFO device 24 (i.e., the received telemetry data).

Figure 3:
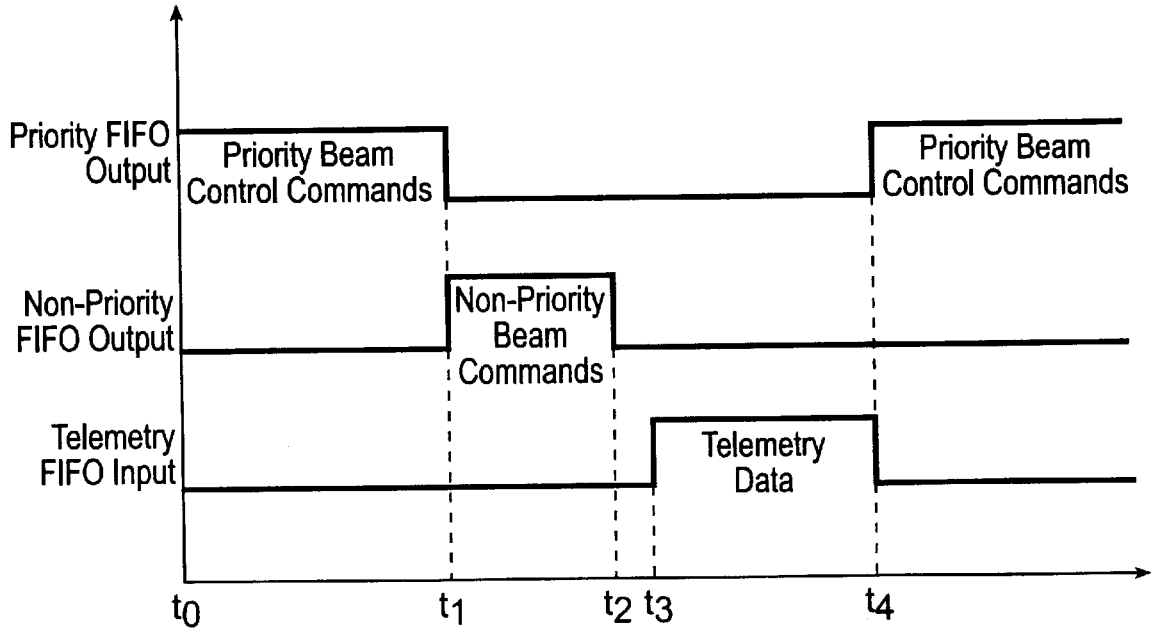
FIG. 3 is a timing diagram illustrating prioritized beam control command and data transfer according to the present invention.

More particularly, as illustrated in the timing diagram of FIG. 3, the priority beam control commands are sent to the subarray controllers 13*a*–13*n* via the communications bus 17 on a substantially real time basis with time gaps therebetween. As illustratively shown in FIG. 3, the priority beam control commands are transmitted from a time to until the beginning of a time gap at a time $t_1$. The time gap extends from the time $t_1$ until a time $t_4$, at which point more priority beam control signals are sent via the arbiter 25 and communications bus 17 to the subarray controllers 13*a*–13*n*.

The non-priority beam control commands are sent to the subarray controllers 13*a*–13*n* via the arbiter 25 and communications bus 17 during the time gaps. Thus, at the time $t_1$ the arbiter 25 connects the output of the non-priority FIFO 23 device to the communications bus 17 to send the non-priority beam control commands until a time $t_2$. If one of the non-priority beam control commands is a telemetry request command, for example, the arbiter 25 may then connect the input of the telemetry FIFO device 24 to the communications bus 17 to receive the telemetry data until the time $t_4$, when the arbiter resumes sending priority beam control commands.

It will be appreciated by those of skill in the art that a more efficient bandwidth utilization is achieved according to the present invention by assigning relative priorities to the beam control commands and data to be sent on the communications bus 17. Even further efficiency gains may be achieved by performing partial processing on the host commands to generate the priority beam control commands, as disclosed in U.S. Pat. No. 5,990,830, discussed above. More particularly, the central controller 16 may perform the requisite trigonometric processing to convert the host commands (e.g., beam steering commands) into priority phase gradient commands for all of the subarray controllers 13*a*–13*n*, for example.

As a result, the amount of priority (i.e., real time) beam control commands that must be sent via the communications bus 17 is reduced. That is, respective priority beam control commands do not have to be generated and sent by the central controller 16 for each phased array antenna element 12. Rather, each subarray controller 13*a*–13*n* may convert the priority beam control commands (e.g., phase gradients) into commands for respective phased array antenna elements 12 connected thereto. This may be done using relatively simple mathematical operations (e.g., multiplication, addition) and without significant increases in circuit complexity. In some embodiments, certain non-priority beam control commands (e.g., temperature compensation data update commands) may similarly be generated by the central controller 16 for all of the subarray controllers 13*a*–13*n* and converted into respective commands for the phased array antenna elements 12 by the subarray controllers to provide even further efficient bandwidth utilization.

For example, a temperature compensation data update command may include new temperature compensation data for a particular phase shifter. While this command may be broadcast to all subarray controllers 13*a*–13*n*, preferably only the intended destination will use this data. Subsequent commands may update the compensation data for the other antenna elements 12. If an element or subarray controller already had temperature compensation data for all temperatures, then a low priority temperature compensation command could in that case be simply broadcast to all of the subarray controllers 13*a*–13*n*.

Still further bandwidth efficiency may be achieved according to the present invention by using a "zero insert" encoding protocol, for example, for sending commands and data via the communications bus 17. Using this protocol, beam control commands and data are sent as standard non-return-to-zero (NRZ) data with the exception that a zero is inserted when a predetermined number of logic 1's (e.g., five) are sent in a row. By way of example, a data message of eight logic 1's (11111111) is encoded as 111110111. Additionally, encoded messages with more than five logic 1's in a row may be assigned a particular meaning, such as 011111110 as a "start of message" or 11111111 as a reset command for the subarray controllers 13*a*–13*n*.

As will be appreciated by those of skill in the art, the above zero insert encoding protocol reduces bandwidth requirements and simplifies bus synchronization and the detection of message headers. Of course, other suitable encoding protocols such as 8B/10B, Manchester encoding, etc. may also be used in accordance with the present invention.

Figure 4:
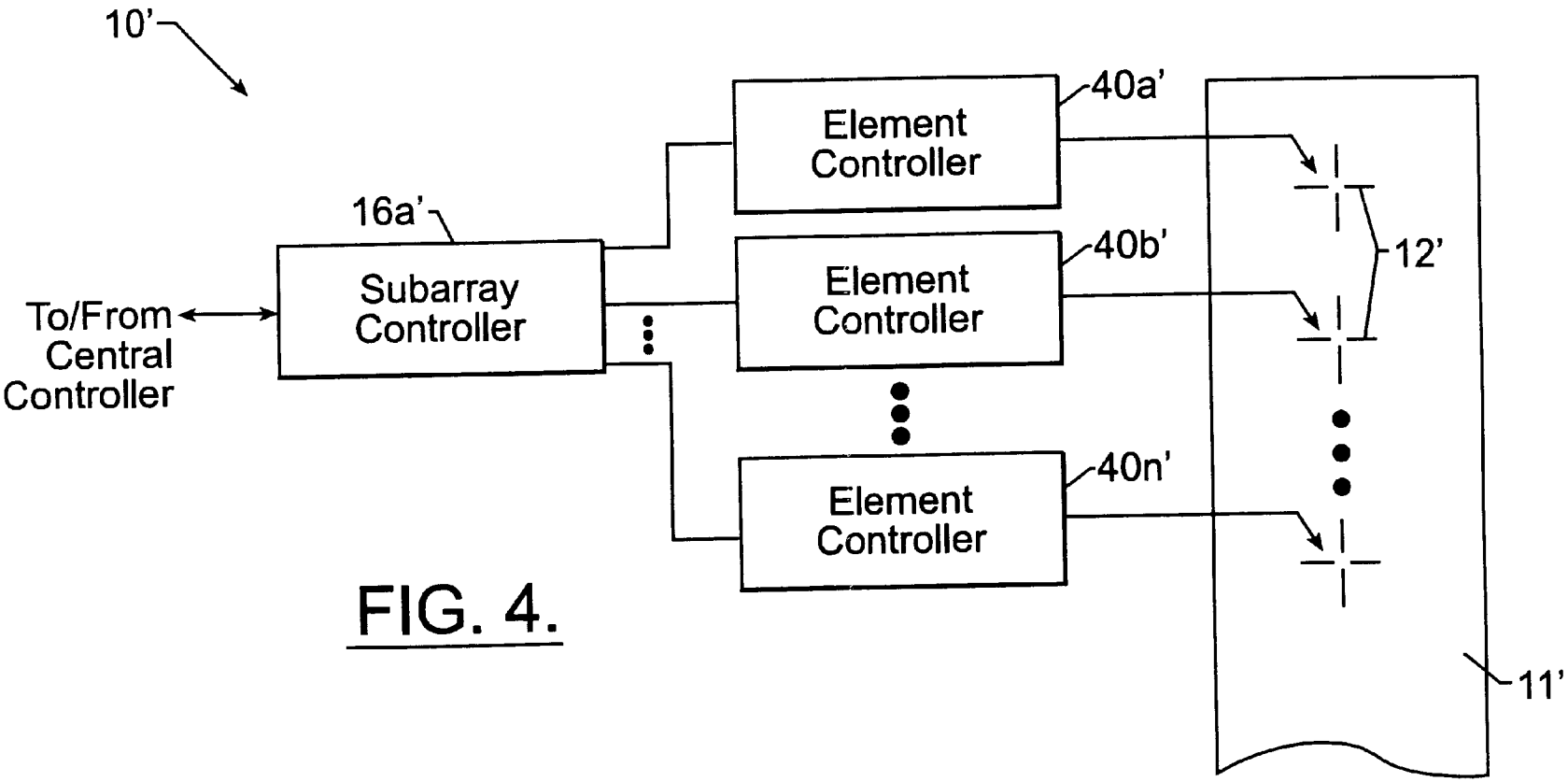
FIG. 4 is a schematic block diagram illustrating an alternate embodiment of the phased array antenna system of FIG. 1 including element controllers.

Turning now additionally to FIG. 4, an alternate embodiment of a phased array antenna system 10' according to the invention is illustratively shown. The phased array antenna system 10' includes a respective element controller 40*a*'–40*n*' for controlling each of the phased array antenna elements 12'. Each element controller 40*a*'–40*n*' may include respective control circuitry, phase shifters, attenuators, delay generators, amplifiers, etc. for each phased array antenna element 12', as will be appreciated by those of skill in the art.

Of course, in some embodiments each element controller 40*a*'–40*n*' may be used to control more than one antenna element 12'. Further, it should also be understood that the various components of the element controllers 40*a*'–40*n*' may be included in the respective subarray controller 16*a*'. Distinction between the two types of controllers is made herein for clarity of explanation, but either one or the other may be used in accordance with the present invention, or both, as will be understood by those skilled in the art.

Figure 5:
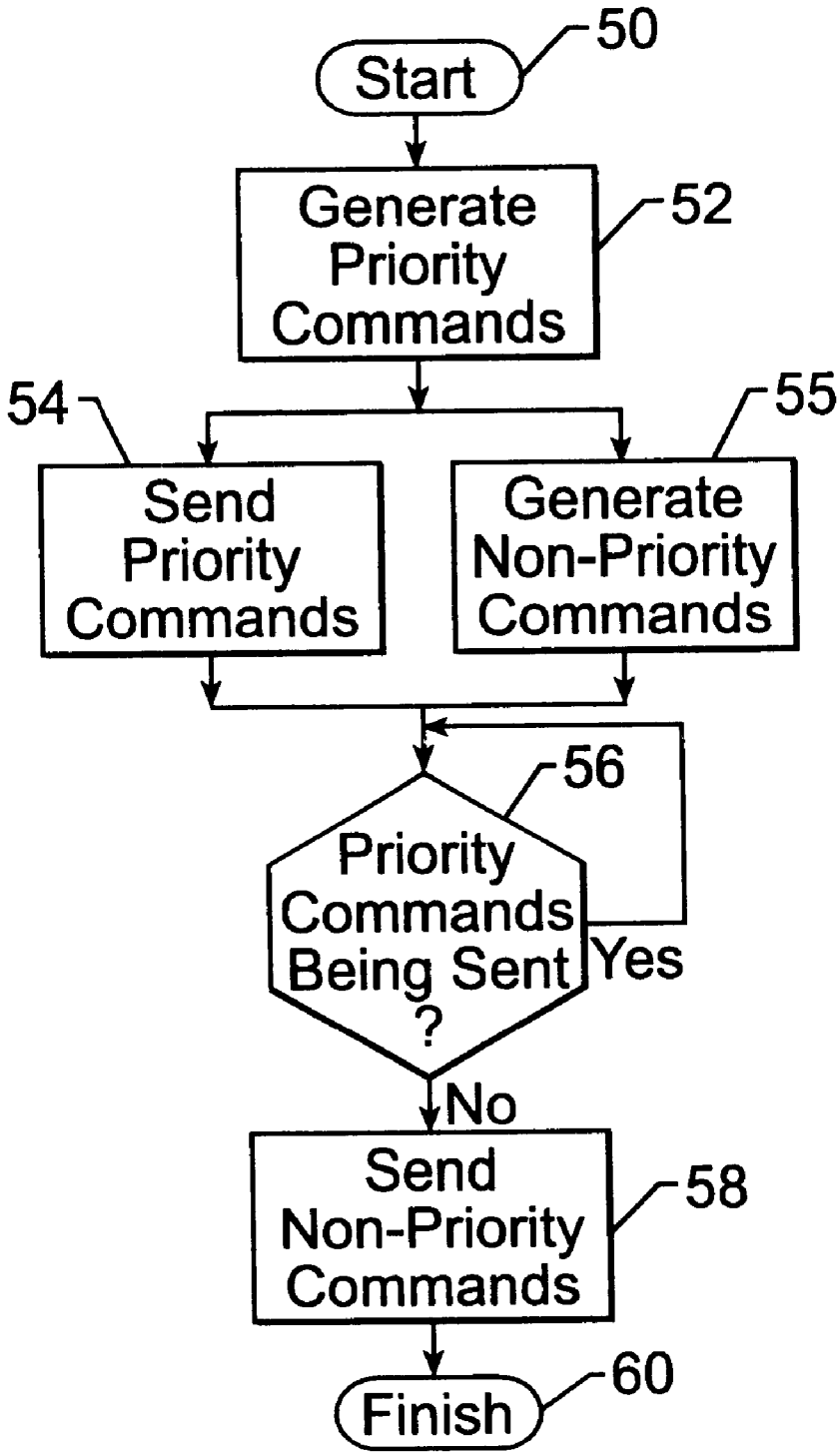
FIG. 5 is flow diagram illustrating a method according to the present invention.

Referring now to FIG. 5, a method aspect of the invention is for providing beam control commands to a plurality of subarray controllers 13*a*–13*n* in a phased array antenna system 10. The method begins (Block 50) with generating priority beam control commands and non-priority beam control commands for the subarray controllers 13*a*–13*n* and writing the priority beam control commands to the priority FIFO 22, at Block 52. Further, the method also includes sending the priority beam control commands (Block 54) to the subarray controllers 13*a*–13*n* on a higher time priority basis than the non-priority beam control commands. More particularly, the priority beam control commands may be sent while the non-priority beam control commands are being generated (Block 55) and written to the non-priority FIFO 23. The arbiter 25 may then determine whether priority commands are currently being sent (Block 56), and if they are then the arbiter will wait until a time gap occurs and send the non-priority commands during the time gap, at Block 58, thus ending the method (Block 60).

It should be noted that generally only a limited number of non-priority messages will fit into one time gap. That is, the arbiter 25 preferably only allows a limited number of non-priority messages to be sent without overlapping onto the upcoming time slot for priority command messages. Further, priority messages need not always be sent immediately when they are received from the host processor 15. The arbiter 25 could include a synchronizing capability that only sends the next priority message based on a synchronizing pulse provided by either the host processor 15 or, in some cases, by the central controller 16. Further aspects of the above method will be apparent to those skilled in the art based upon the above description.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

What is claimed is:

1. A phased array antenna system comprising:

a substrate and a plurality of phased array antenna elements carried thereby;

a plurality of subarray controllers for controlling respective groups of phased array antenna elements;

a central controller for generating priority beam control commands and non-priority beam control commands for said subarray controllers; and a communications bus connecting said subarray controllers to said central controller;

said central controller sending the priority beam control commands to said subarray controllers via said communications bus on a substantially real time basis with time gaps therebetween, and sending the non-priority beam control commands to said subarray controllers via said communications bus during the time gaps.

2. The phased array antenna system of claim 1 wherein said central controller comprises:

a priority first-in, first-out (FIFO) device for storing and outputting the priority beam control commands;

a non-priority FIFO device for storing and outputting the non-priority beam control commands; and an arbiter for selectively connecting the outputs of said priority FIFO device and said non-priority FIFO device to said communications bus.

3. The phased array antenna system of claim 2 wherein said subarray controllers collect telemetry data for respective groups of phased array antenna elements and send the telemetry data to said central controller via said communications bus; wherein said central controller further comprises a telemetry FIFO device connected to said arbiter; and wherein said arbiter further selectively connects the telemetry FIFO device to said communications bus during the time gaps for storing the telemetry data.

4. The phased array antenna system of claim 1 wherein the priority beam control commands comprise at least one of phase gradient commands, beam spoiling commands, and operating frequency commands.

5. The phased array antenna system of claim 1 wherein the non-priority beam control commands comprise at least one of temperature compensation commands and telemetry request commands.

6. The phased array antenna system of claim 1 wherein the priority beam control commands are the same for all of the subarray controllers.

7. The phased array antenna system of claim 6 wherein the non-priority beam control commands are the same for all of the subarray controllers.

8. The phased array antenna system of claim 7 wherein each subarray controller converts the priority and non-priority beam control commands into commands for respective phased array antenna elements connected thereto.

9. The phased array antenna system of claim 1 wherein said central controller generates the priority beam control commands based upon host commands.

10. The phased array antenna system of claim 1 further comprising a respective element controller for controlling each of said phased array antenna elements.

11. A phased array antenna system comprising:

a substrate and a plurality of phased array antenna elements carried thereby;

a plurality of subarray controllers for controlling respective groups of phased array antenna elements;

a host processor for generating host commands;

a central controller connected to said host processor for generating priority beam control commands and non-priority beam control commands for said subarray controllers based upon the host commands; and a communications bus connecting said subarray controllers to said central controller;

said central controller sending the priority beam control commands to said subarray controllers via said communications bus on a substantially real time basis with time gaps therebetween, and sending the non-priority beam control commands to said subarray controllers via said communications bus during the time gaps.

12. The phased array antenna system of claim 11 wherein said central controller comprises:

a priority first-in, first-out (FIFO) device for storing and outputting the priority beam control commands;

a non-priority FIFO device for storing and outputting the non-priority beam control commands; and an arbiter for selectively connecting the outputs of said priority FIFO device and said non-priority FIFO device to said communications bus.

13. The phased array antenna system of claim 12 wherein said subarray controllers collect telemetry data for respective groups of phased array antenna elements and send the telemetry data to said central controller via said communications bus; wherein said central controller further comprises a telemetry FIFO device connected to said arbiter; and wherein said arbiter further selectively connects the telemetry FIFO device to said communications bus during the time gaps for storing the telemetry data.

14. The phased array antenna system of claim 11 wherein the priority beam control commands comprise at least one of phase gradient commands, beam spoiling commands, and operating frequency commands.

15. The phased array antenna system of claim 11 wherein the non-priority beam control commands comprise at least one of temperature compensation commands and telemetry request commands.

16. The phased array antenna system of claim 11 wherein the priority beam control commands are the same for all of the subarray controllers, and wherein the non-priority beam control commands are also the same for all of the subarray controllers.

17. The phased array antenna system of claim 16 wherein each subarray controller converts the priority and non-priority beam control commands into commands for respective phased array antenna elements connected thereto.

18. The phased array antenna system of claim 11 further comprising a respective element controller for controlling each of said phased array antenna elements.

19. A central controller for a phased array antenna system comprising:

a processor for generating priority beam control commands and non-priority beam control commands; and a bus interface for outputting the priority beam control commands to a communications bus on a higher time priority basis than the non-priority beam control commands.

20. The central controller of claim 19 wherein the priority beam control commands are output on a substantially real time basis with time gaps therebetween, and wherein the non-priority beam control commands are sent during the time gaps.

21. The central controller of claim 19 wherein said bus interface comprises:

a priority first-in, first-out (FIFO) device connected to said processor for storing and outputting the priority beam control commands;

a non-priority FIFO device connected to said processor for storing and outputting the non-priority beam control commands; and an arbiter for selectively connecting the outputs of said priority FIFO device and said non-priority FIFO device to the communications bus.

22. The central controller of claim 21 wherein said bus interface further comprises a telemetry FIFO device connected to said arbiter, and wherein said arbiter further selectively connects the telemetry FIFO device to the communications bus for receiving and storing telemetry data on a lower time priority basis than the priority beam control commands.

23. The central controller of claim 19 wherein said processor generates the priority beam control commands based upon host commands.

24. The central controller of claim 19 wherein the priority beam control commands comprise at least one of phase gradient commands, beam spoiling commands, and operating frequency commands.

25. The central controller of claim 19 wherein the non-priority beam control commands comprise at least one of temperature compensation commands and telemetry request commands.

26. A method for providing beam control commands to a plurality of subarray controllers in a phased array antenna system, the method comprising:

generating priority beam control commands and non-priority beam control commands for the subarray controllers; and sending the priority beam control commands to the subarray controllers on a higher time priority basis than the non-priority beam control commands.

27. The method of claim 26 wherein sending the priority beam control commands comprises sending the priority beam control commands on a substantially real time basis with time gaps therebetween, and wherein sending the non-priority beam control commands comprises sending the non-priority beam control commands during the time gaps.

28. The method of claim 26 wherein the priority beam control commands comprise at least one of phase gradient commands, beam spoiling commands, and operating frequency commands.

29. The method of claim 26 wherein the non-priority beam control commands comprise at least one of temperature compensation commands and telemetry request commands.

30. The method of claim 26 wherein the priority beam control commands are the same for all of the subarray controllers.

31. The method of claim 26 wherein the non-priority beam control commands are the same for all of the subarray controllers.

32. The method of claim 26 wherein generating the priority beam control commands comprises generating the priority beam control commands based upon host commands.

* * * * *